US005801136A

United States Patent [19]

Henry

[11] Patent Number: 5,801,136

[45] Date of Patent: Sep. 1, 1998

[54] STABILIZED SOLVENTS AND METHOD FOR CLEANING METALLIC, ELECTRICAL AND PLASTIC SUBSTRATES UTILIZING ENVIRONMENTALLY SAFE SOLVENT MATERIALS

[75] Inventor: Richard G. Henry, Mayfield, Ohio

[73] Assignee: Advanced Chemical Design, Inc., Euclid, Ohio

[21] Appl. No.: 598,798

[22] Filed: Feb. 9, 1996

Related U.S. Application Data

[63] Continuation-in-part of Ser. No. 293,047, Aug. 19, 1994, abandoned.

[51] Int. Cl.[6] ..... C11D 7/30; C11D 7/34; C11D 7/26; B08B 3/08

[52] U.S. Cl. ..... 510/175; 510/176; 510/412; 510/255; 510/256; 510/264; 510/273; 510/365; 510/266; 252/364; 134/11; 134/31; 134/40; 134/12; 134/38; 134/42

[58] Field of Search ..... 510/176, 175, 510/412, 255, 256, 264, 273, 365, 461, 266; 134/11, 31, 40, 12, 38, 42; 252/364

[56] References Cited

U.S. PATENT DOCUMENTS

| | | | |
|---|---|---|---|
| 3,049,571 | 8/1962 | Brown | 260/652.5 |
| 3,113,156 | 12/1963 | Sims | 260/652.5 |
| 3,657,120 | 4/1972 | Porst | 252/8 |
| 3,773,677 | 11/1973 | Boyles | 252/172 |
| 3,879,297 | 4/1975 | Languille et al. | 252/8 |
| 3,881,949 | 5/1975 | Brock | 134/31 |
| 3,924,455 | 12/1975 | Bergishagen et al. | 73/88 |
| 3,950,185 | 4/1976 | Toyama et al. | 134/38 |
| 4,018,837 | 4/1977 | Archer et al. | 260/652.5 R |
| 4,056,403 | 11/1977 | Cramer et al. | 134/22 R |
| 4,115,461 | 9/1978 | Spencer et al. | 260/652.5 R |
| 4,193,838 | 3/1980 | Kelly et al. | 162/5 |
| 4,770,714 | 9/1988 | Buchwald et al. | 134/40 |
| 5,073,290 | 12/1991 | Anton et al. | 252/162 |
| 5,207,953 | 5/1993 | Thorssen et al. | 252/601 |
| 5,286,422 | 2/1994 | Kato et al. | 264/13 |
| 5,302,313 | 4/1994 | Asano et al. | 252/171 |
| 5,397,397 | 3/1995 | Awad | 134/1 |
| 5,403,507 | 4/1995 | Henry | 252/170 |
| 5,616,549 | 4/1997 | Clark | 510/412 |

*Primary Examiner*—Douglas J. McGinty
*Attorney, Agent, or Firm*—Fay, Sharpe, Beall, Fagan, Minnich & McKee

[57] ABSTRACT

A stabilized, environmentally-safe solvent mixture and method for using the mixture are provided. The solvent mixture has an ozone depletion factor of less than 0.08. The mixture includes about 80–96.8%, by volume, chlorobromomethane and about 3.2–20.0%, by volume, of a mixture of stabilizers. The mixture of stabilizers includes nitromethane, 1,2-butylene oxide, and 1,3-dioxolane. The mixture of stabilizer inhibits the decomposition of chlorobromomethane. The solvent mixture is particularly effective for cleaning articles having hydrocarbon-soluble contaminants, especially in a vapor degreaser.

20 Claims, No Drawings

STABILIZED SOLVENTS AND METHOD FOR CLEANING METALLIC, ELECTRICAL AND PLASTIC SUBSTRATES UTILIZING ENVIRONMENTALLY SAFE SOLVENT MATERIALS

CROSS REFERENCE TO RELATED APPLICATION

This application is a Continuation-in-Part of U.S. patent application Ser. No. 08/293,047, which was filed Aug. 19, 1994, now abandoned.

FIELD OF THE INVENTION

This invention relates to cleaning articles by vapor degreasing; and more particularly to the removal of organic materials from metallic and electrical materials with a solvent mixture containing chlorobromomethane and a mixture of stabilizers.

BACKGROUND OF THE INVENTION

The utilization of vapor degreasing techniques has found wide acceptance in industry for removing hydrocarbon contaminates from metallic and electrical materials. This method of cleaning typically involves the heating of a solvent to a boil to generate a vapor layer over the solvent, into which the object to be cleaned is placed. This vapor layer is a mixture of air and solvent, in which the air has reached its saturation point with the solvent. The solvent condenses upon the object placed in the vapor layer and drips off of the object into a holding tank. The condensation dissolves the hydrocarbon contaminants and removes them from the object, thereby cleaning it. This technique is a preferred method of cleaning precision parts, such as electronics, machined metallic parts, etc., since vapor cleaning leaves virtually no residue upon the parts.

Vapor degreasing has been found particularly valuable for the removal of flux from soldered circuit boards. A typical circuit board consists of a thin plate normally of epoxy resin or similar material reinforced with glass fibers carrying electrical connectors on one or both sides consisting of thin strips of copper or other electrically conductive material. Electronic components are normally placed on the side opposite the conductors and by means of leads passing through holes in the board are attached to the connectors by crimping the leads followed by soldering. Soldering is typically carried out by first coating the connector side of the board with a flux and then passing the side of the board over a surface of molten solder. The fluxes employed consist, for the most part, of rosin. Also gaining acceptance in the art are rosin fluxes which are activated by the addition of ionic materials. Such activators insure better solder bonds, especially on slightly corroded connectors and leads.

A choice of solvent for removal of the flux is restricted by the need to insure that the solvent will not attack the board or the various material of construction or any of the electronic components contained thereon. Alcohols have been used in the past, however, their use is limited because of the severe danger of fire. Non-flammable materials employed in the past as a solvent medium include CFC 113, 1,1,1-trichloroethane ("1,1,1-TCE"), perchloroethylene, 1,1,1-trichloroethylene and various hydrochlorofluorocarbons, such as "Genesolve" (manufactured by Allied, Chemical). Such a vapor degreasing technique employing the same or similar materials is taught by U.S. Pat. No. 3,881,949 which issued on May 6, 1975 to Carl Martin Brock. The teachings of which are hereby incorporated by reference.

The solvents described above and in the Brock patent are typically on the Clean Air Act list of ozone depleting chemicals and are being or have been phased out of production because of their danger to the environment. Thus, a suitable replacement is necessary to substitute for these banned ozone depleting chemicals.

U.S. Pat. No. 4,056,403, which issued to Robert J. Cramer et al. on Nov. 1, 1977, describes a method in which a number of non ozone depleting chemicals, including chlorobromomethane, are used in cleaning polyurethane foam generating equipment. Cramer et al. teach that the cleaning operation takes place after rinsing or flushing the entire foaming apparatus has been exhausted of foam forming chemicals. The solvents taught may be periodically injected under pressure through the mixer portion of the foaming apparatus in order to purge it of residual unreacted or partially foam forming materials. However, the method described in this patent is totally ineffective to vapor clean metallic or electronic parts because its composition does not include the appropriate stabilizers which would prevent the chlorobromomethane from becoming acidic and thereby attacking the metal surfaces which might be placed into the vapor layer.

Use of hot saturated vapors of a liquid halogenated hydrocarbon, including chlorobromomethane, is taught in U.S. Pat. No. 4,193,838 which issued to Robert J. Kelly et al. on Mar. 18, 1980. This patent teaches the maintenance of a pool of hot saturated vapors of a halogenated acyclic hydrocarbon to remove the coating from coated paper stock, which has been coated with "hot melt" coatings such as are used on consumer items and milk cartons, into a vapor pool. The paper stock is placed into the pool of vapors and then agitated. This method is also ineffective for cleaning circuit boards and other metallic materials because of the acidic nature of the non stabilized compounds utilized therein which would tend to destroy the object being cleaned rather than clean it.

It is the object of the present invention to provide materials which are suitable for vapor cleansing of electronic and metallic parts without the use of ozone depleting chemicals and which are appropriate for the cleaning of metal.

SUMMARY OF THE INVENTION

It is the primary purpose of the present invention to develop an environmentally safe "drop in" substitute for 1,1,1-TCE and CFC solvents which are utilized, at the present, in vapor degreasing equipment. Chlorobromomethane, because of its non-flammability, high solvency and very low ozone depleting potential is an appropriate material for use in such solvents. However, it has been discovered that excessive pitting and corrosion would appear on metals cleaned by chlorobromomethane unless appropriate stabilizers, as indicated, have been added.

It has now been found that chlorobromomethane can be stabilized with a stabilizer mixture of three low boiling solvents to prevent the chlorobromomethane from turning acidic and releasing free bromine into the air. The stabilizer mixture comprises nitromethane, 1,2-butylene oxide and 1,3-dioxolane or 1,4-dioxane. It has also been found that various terpene hydrocarbons and terpene alcohols as well as mineral spirits, glycol ethers, alcohols, and ketones can be used in conjunction with the above identified stabilizer mixture.

A better understanding of the present invention can be had by reference to the following detailed description and, particularly, to several included examples to outline the vapor decreasing solvent which effectively meets the object outlined above.

DETAILED DESCRIPTION

In accordance with the present invention, chlorobromomethane stabilized with appropriate stabilizers, such as a mixture of nitromethane, 1,2-butylene oxide and 1,4-dioxane or 1,3-dioxolane, may be utilized as a vapor degreasing solvent in standard sump type or ultrasonic vapor degreasing equipment as a replacement for environmentally unfriendly solvents such as 1,1,1-TCE and other chlorofluorocarbon solvents.

A vapor degreasing solvent should have the following characteristics for proper cleaning of metal, plastic, elastomers, and circuit boards: it must be properly stabilized with one solvent from the acetal group; be non-flammable; and it should have an ozone depletion potential of less than 0.08. It should also have a high solvency with a Kauri-Butanol value above 100. Additionally, it should include an evaporation rate of at least 3 and on evaporation leave behind no residue. The solvent should have a latent heat of evaporation of 31 Kcal/mole so as to facilitate condensation of the solvent on the cold side of a standard degreasing system where excess solvent vapors can condense and then be recirculated back to the boiling side. This arrangement helps insure that there is fresh solvent boiling at all times. When the solvent mixture becomes too contaminated with oil, grease or flux, the boiling point of the solvent mixture will increase. When the boiling point of the solvent mixture reaches 170 degrees Fahrenheit, the solvent mixture must be replaced.

It has been discovered that an efficient vapor degreasing solvent mixture comprises about 80–96.8%, by volume, chlorobromomethane; about 3.2–20.0%, by volume, of a mixture of stabilizers to inhibit the release of bromine into the atmosphere from the chlorobromomethane; and up to 5%, by volume, of an additional solvent. The stabilizer mixture comprises (1) nitromethane, (2) 1,2-butylene oxide and (3) 1,3-dioxolane or 1,4-dioxane. The additional solvent can be selected from the group consisting of acetone, alcohols having 1–12 carbon atoms or mixtures thereof, mineral spirits, paramenthane and terpene hydrocarbons.

In a preferred embodiment, the solvent mixture comprises about 93–96.5%, by volume, chlorobromomethane and about 3.5–7%, by volume, of the mixture of stabilizers wherein the stabilizer mixture comprises 0.1–1.0%, by volume, nitromethane; 0.1–1.0%, by volume, 1,2-butylene oxide; and about 3–5%, by volume, 1,3-dioxolane or 1,4-dioxane.

In a more preferred embodiment, the solvent mixture comprises about 95%, by volume, chlorobromomethane and about 5%, by volume, of the stabilizer mixture wherein the stabilizer mixture comprises about 0.5%, by volume, nitromethane; about 0.5%, by volume, 1,2-butylene oxide; and about 4.0%, by volume, 1,3-dioxolane or 1,4-dioxane.

Some solvent containing mixtures containing the additional solvent will appear cloudy indicating that the two solvent components are not necessarily completely compatible. By mixing two solvents together, a wide variety of soils or contaminants can be removed. Some of the acceptable combinations are described in TABLE 1 below.

TABLE 1

| Vapor Mixture | Solution Clarity | Solution Layer |
|---|---|---|
| Chlorobromomethane/limonene/stabilizers | Clear | Yes |
| Chlorobromomethane/Dipentene/stabilizers | Clear | Yes |
| Chlorobromomethane/mineral spirits/ stabilizers | Clear | Yes |
| Chlorobromomethane/glycol ethers/ stabilizers | Cloudy | Yes |
| Chlorobromomethane/acetone/stabilizers | Cloudy | Yes |
| Chlorobromomethane/Isopropyl Alcohol stabilizers | Cloudy | Yes |

In the present invention, a solvent mixture of chlorobromomethane and stabilizers are added to a conventional vapor degreaser such as Baron-Blakeslee or Branson models. The thermostat is then set at 155 degrees Fahrenheit with the included mixture allowed to reach this temperature after approximately ½ hour. At the temperature of 155 degrees Fahrenheit, the solvent mixture boils and this temperature must be reached before any vapors appear. When the temperature of 155 degrees Fahrenheit is attained, a vapor layer will appear above the solvent mixture as a "fog". This fog constitutes the principal feature of cleaning by the vapor method. When the fog appears, an object to be cleaned is placed into the vapor layer and the solvent mixture condenses onto the object. When condensation takes place, any oil, grease, rosin, flux or similar organic material which was on the object is dissolved and drips back down into the boiling solvent mixture and thereby is removed, effectively cleaning the object deposited into the fog. The vapors from the solvent do not contain any of the removed contaminants and therefore are ready to clean more objects of any hydrocarbon soluble contaminants.

EXAMPLE 1

Five gallons of a 95%, by volume, chlorobromomethane mixture stabilized by the addition of 0.5%, by volume, nitromethane, 0.5%, 1,2-butylene oxide, and 4%, by volume, 1,3-dioxolane was added to a standard sump type vapor degreaser. The total was blended and added together. The thermostat on the vapor degreaser was adjusted to 155 degrees Fahrenheit and the system was allowed to equilibrate. After the mixture inside the solvent reservoir reached 155 degrees Fahrenheit, the mixture began to boil. A vapor layer of approximately 7 inches deep formed inside the unit. Enough vapor was evolved so as to condense and be circulated from the chilled side of the degreaser and be returned to the boiling side.

A circuit board having approximately 1 gram of rosin flux was immersed into the vapor layer. Chlorobromomethane was then seen to condense onto the circuit board and dissolve the rosin flux. After approximately one minute had passed, the circuit board was removed from the vapor layer. The observed circuit board contained no rosin flux. The flux had been removed by the solvent vapor and dripped off into the boiling solvent. The same procedure outlined above was utilized on pieces of sheet metal containing light mineral oils, silicone oils, lithium greases and other types of industrial release fluids. Similar results were obtained.

EXAMPLE 2

In another embodiment of the present invention, five gallons of the above composition were added to a vapor degreaser with 1,3 dioxolane being replaced by 1,4 dioxane. Again, the thermostat was adjusted to 155 degrees Fahrenheit and the system was allowed to equilibrate. After the solvent blend reached 155 degrees Fahrenheit, a vapor layer approximately 7 inches deep was again observed inside the solvent reservoir. A steel bolt was placed inside the vapor layer which had lithium soap based grease smeared on it. After 1 one minute has passed, the bolt was removed from the vapor layer. All of the lithium soap based grease had been removed and the part was now completely clean.

Other approaches included using the same mixture as above with mineral spirits replacing 5% of the chlorobromomethane as part of the total solvent mixture added to the boiling sump of a vapor degreaser. Again, similar results were obtained.

Also, mixtures of 5% C1, C2, C3, C4, C5, C6, C7, C8, C9, C10, C11 and C12 alcohols with one OH group were individually substituted for the mineral spirits in the above example. Here too, similar results were obtained.

Finally, a mixture of 5% para-menthane was substituted for mineral spirits. Similar results were also obtained.

Thus, it can be seen from the foregoing that a properly stabilized mixture of chlorobromomethane and various solvents can effectively be utilized as a vapor cleaning solvent in the effective cleaning of organic materials from the surfaces of electrical and metallic parts.

EXAMPLE 3

Corrosion tests were also performed as oxidation is a potential problem as with all solvent cleaners. In performing these tests, strips of copper and steel measuring 1" wide by 6" long and of 20 mil thickness were buffed on a belt sander to remove any oxide films. Fifty milliliters of the above mentioned solvents were placed in a cylindrical Pyrex glass container and strips were placed in the containers so that 75% of the surface was immersed in the solvent. A sample container filled with tap water was used as a control for the test to insure that there were no alloys in the metal strips that would have been prevented oxidation. The openings of the sample containers were all sealed with cork stoppers to reduce evaporation. After an appropriate time, the strips were removed and it was determined that all of the solvent types described above all were found to be non-corrosive.

While selected embodiments of the present invention have been described, it will be obvious to those skilled in the art that numerous modifications may be made without departing from, the spirit of the, present invention, which shall be limited only by the scope of the, claims appended hereto.

What is claimed is:

1. A solvent mixture having an ozone depletion factor of less than 0.08, for use in a vapor degreasing system, consisting essentially of:

about 80–96.8% by volume, chlorobromomethane;

about 3.2–20.0%, by volume, of a mixture of stabilizers consisting essentially of:

(1) nitromethane;

(2) 1,2-butylene oxide, and (3) 1,3-dioxolane, the mixture of stabilizers being effective to inhibit the release of bromine into the atmosphere from the chlorobromomethane.

2. A solvent mixture having an ozone depletion factor of less than 0.08 comprising about 80–96.8%, by volume, chlorobromomethane and about 3.2–20%, by volume, of a mixture of stabilizers consisting essentially of:

nitromethane;

1,2-butylene oxide; and, 1,3-dioxolane.

3. The solvent mixture of claim 2 wherein the mixture of stabilizers consists essentially of, approximately by volume of the solvent mixture, 0.1–5% nitromethane; approximately 0.1–5% 1,2-butylene oxide; and approximately 3–10% 1,3-dioxolane.

4. The solvent mixture of claim 2 wherein the solvent mixture consists essentially of:

about 93–96.5%, by volume, chlorobromomethane; and, about 3.2–7.0%, by volume, of the stabilizer mixture, wherein the stabilizer mixture consists essentially of, approximately by volume of the solvent mixture, 0.1–1.0% nitromethane; approximately 0.1–1.0% 1,2-butylene oxide; and, approximately 3–5% 1,3-dioxolane.

5. The solvent mixture of claim 1 wherein the mixture of stabilizers inhibits the chlorobromomethane from becoming acidic while in operation in the vapor degreasing system.

6. The solvent mixture of claim 1 wherein the mixture of stabilizers consists essentially of, approximately by volume of the solvent mixture, 0.1–5% nitromethane; approximately 0.1–5% 1,2-butylene oxide; and approximately 3–10% 1,3-dioxolane.

7. The solvent mixture of claim 6 wherein the solvent mixture consists essentially of:

about 93–96.5%, by volume, chlorobromomethane; and about 3.2–7.0%, by volume, of the stabilizer mixture, wherein the stabilizer mixture consists essentially of, approximately by volume of the solvent mixture, 0.1–1.0% nitromethane; approximately 0.1–1.0% 1,2-butylene oxide; and, approximately 3–5% 1,3-dioxolane.

8. The solvent mixture of claim 6 wherein the mixture of stabilizers consists essentially of, approximately by volume of the solvent mixture, 0.5% nitromethane; approximately 0.5% 1,2-butylene oxide; and, approximately 4% 1,3-dioxolane.

9. The solvent mixture of claim 2 wherein the stabilizer mixture consists essentially of, approximately by volume of the solvent mixture, 0.5% nitromethane; approximately 0.5% 1,2-butylene oxide; and, approximately 4% 1,3-dioxolane.

10. The solvent mixture of claim 1 wherein the solvent mixture in operation in a vapor degreasing system leaves no residue.

11. The solvent mixture of claim 1 wherein the solvent mixture has a latent heat of evaporation of 31 Kcal/mole, facilitating condensation of the solvent in a vapor degreasing system.

12. A solvent mixture having an ozone depletion factor of less than 0.08, for use in a vapor degreasing system, consisting essentially of:

about 95% by volume, chlorobromomethane; and about 5%, by volume, of a mixture of stabilizers consisting essentially of, approximately by volume of the solvent mixture, about 0.5% nitromethane;

about 0.5% 1,2-butylene oxide; and about 4.0% 1,3-dioxolane;

the mixtures of stabilizers being operated to inhibit the release of bromine into the atmosphere from the chlorobromomethane.

13. A method for vapor cleaning articles comprising the steps of:

providing a solvent mixture having an ozone depletion factor of less than 0.08 comprising about 80–96.8%, by volume, chlorobromomethane and about 3.2–20%, by volume, of a mixture of stabilizers consisting essentially of nitromethane, 1,2-butylene oxide, and 1,3-dioxolane;

heating the solvent mixture to its boiling point to produce a vapor layer above the solvent;

placing an article containing contaminants into the vapor layer;

condensing the solvent mixture onto the article;

dissolving said contaminants in said solvent mixture;

removing said solvent mixture containing said contaminants; and removing the article from the vapor layer.

14. The method according to claim 13 wherein said mixture of stabilizers consists essentially of, approximately by volume of the solvent mixture, 0.1–5% nitromethane; approximately 0.1–5% 1,2-butylene oxide; and approximately 3–10% 1,3-dioxolane.

15. The method according to claim 14 wherein the solvent mixture is provided in a vapor degreasing apparatus.

16. The method according to claim 15 wherein the article is metal, plastic or an elastomer.

17. The method according to claim 15 wherein the article is a circuit board.

18. The solvent mixture of claim 2 wherein the mixture of stabilizers inhibits the chlorobromomethane from becoming acidic.

19. The solvent mixture of claim 2 wherein the solvent mixture has a latent heat of evaporation of 31 Kcal/mole, facilitating condensation of the solvent in a vapor degreasing system.

20. The solvent mixture of claim 2 wherein the solvent mixture in an operation in a vapor degreasing system leaves no residue.

* * * * *